United States Patent [19]

Yarbrough et al.

[11] Patent Number: 4,693,588

[45] Date of Patent: Sep. 15, 1987

[54] THERMAL AIR CURTAIN FOR A COPYING/PRINTING MACHINE

[75] Inventors: Joseph A. Yarbrough, Rochester; David O. Kingsland, Fairport; Donald L. Pease, Haneoye, all of N.Y.

[73] Assignee: Xerox Corporation, Stamford, Conn.

[21] Appl. No.: 853,819

[22] Filed: Apr. 9, 1986

[51] Int. Cl.[4] ..... G03G 15/00

[52] U.S. Cl. ..... 355/3 R; 219/216; 219/343; 355/3 FU

[58] Field of Search ..... 355/3 R, 3 FU, 14 FU, 355/30; 219/216, 343, 469–471; 165/47

[56] References Cited

U.S. PATENT DOCUMENTS

| | | | |
|---|---|---|---|
| 3,583,805 | 6/1971 | Tanaka | 355/3 FU |
| 3,757,662 | 9/1973 | Ingels | 219/216 |
| 3,901,591 | 8/1975 | Mitsumasu | 219/216 X |
| 3,941,471 | 3/1976 | Schatka et al. | 355/3 FU |
| 4,088,868 | 5/1978 | Zeuthen | 219/216 |
| 4,202,618 | 5/1980 | Waschk et al. | 355/3 FU |
| 4,248,520 | 3/1981 | Kurita et al. | 355/3 FU |
| 4,350,871 | 9/1982 | Davis, Sr. et al. | 219/343 |
| 4,384,783 | 5/1983 | Sakata et al. | 219/216 X |
| 4,413,668 | 11/1983 | Allard | 165/47 X |

*Primary Examiner*—A. T. Grimley
*Assistant Examiner*—Jane K. Lau
*Attorney, Agent, or Firm*—Frederick E. McMullen

[57] ABSTRACT

A compact xerographic copying or printing machine with fuser and xerographic sections placed close together, an air manifold separating the fuser and xerographic sections having plural air passages through which cooling air flows and forming one leg of a U-shaped thermal air curtain, an air baffle between the manifold and fuser sections and cooperating with the outside of the manifold to form the second leg of the air curtain so that air leaving the manifold undergoes a 180° turn and passes through the second leg to a filter and the inlet of an exhaust fan.

2 Claims, 3 Drawing Figures

THERMAL AIR CURTAIN FOR A COPYING/PRINTING MACHINE

The invention relates to a compact copying/printing machine of the type employing a heated fuser to fix transferred images, and more particularly, to a copying/printing machine in which an air curtain is established between the closely adjacent fuser and xerographic section of the machine to inhibit transfer of heat from the fuser to the xerographic section.

In the typical copying/printing machine, a latent electrostatic image is produced on a recording member such as the photoreceptor of a xerographic system. Following this, the image is developed, and then transferred from the recording member to a suitable copy substrate material, typically a sheet of paper. The copy sheet with the transferred image thereon is then fused or fixed to provide a permanent copy.

In most copying/printing machines of this type, fusing or fixing of the image is done in a fuser by heat. In one exemplary system, the fuser employs a heated fusing roll for this purpose. To provide a simplier and less expensive machine, the fuser is designed to operate at the same copy processing speed as the image producing system. It is also desirable, as might be expected, to provide a machine which can process the highest number of copies per minute possible. In a synchronized system, the limiting speed is the speed of the slowest element. To achieve the maximum number of copies per minute and still effectively and reliably fuse, fusers are usually designed to operate at the highest temperature possible. At the same time, it is usually desirable to make the machine as compact, simple, and light weight as possible and this has led to attempts to place the fuser and the imaging system components, i.e. the xerographic section, as near to each other as possible. However, the nearer the fuser is to the xerographic section, the greater the heat transfer from the fuser to the imaging system components. And, as well known, exposure of certain of the xerographic system components such as the photoreceptor to excessive heat can have a deleterious effect on both the operation and life of these components.

In prior art, it is known to provide cooling air to the fuser itself to control fuser temperatures and prevent fuser overheating as shown by U.S. Pat. No. 4,088,868 to Zeuthen. Further, it is known to draw air through a copy machine by means of an exhaust fan for the purpose of reducting and controllinig the build up of ozone generated by the operation of the machine corona devices as shown by U.S. Pat. No. 4,401,385 to Katayama et al.

The present invention, in contrast to the prior art, is concerned with establishing a thermal barrier in the form of an air curtain between the xerographic and fuser section of a copying/printing machine in which the xerographic section includes a photoreceptor on which latent electrostatic images are formed, developed, and transferred to a copy substrate material while the fuser section fixes the developed image transferred to the copy substrate material by heat, with the xerographic section and the fuser section being disposed in close adjoining relation to one another to provide maximum machine compactness, comprising in combination: means for generating a flow of air internally of the machine; and means for routing the air between the xerograpic section and the fuser section to establish a moving air curtain between the xerographic section and the fuser section which inhibits the transfer of heat from the fuser section to the xerographic section.

IN THE DRAWINGS

Figure 1:
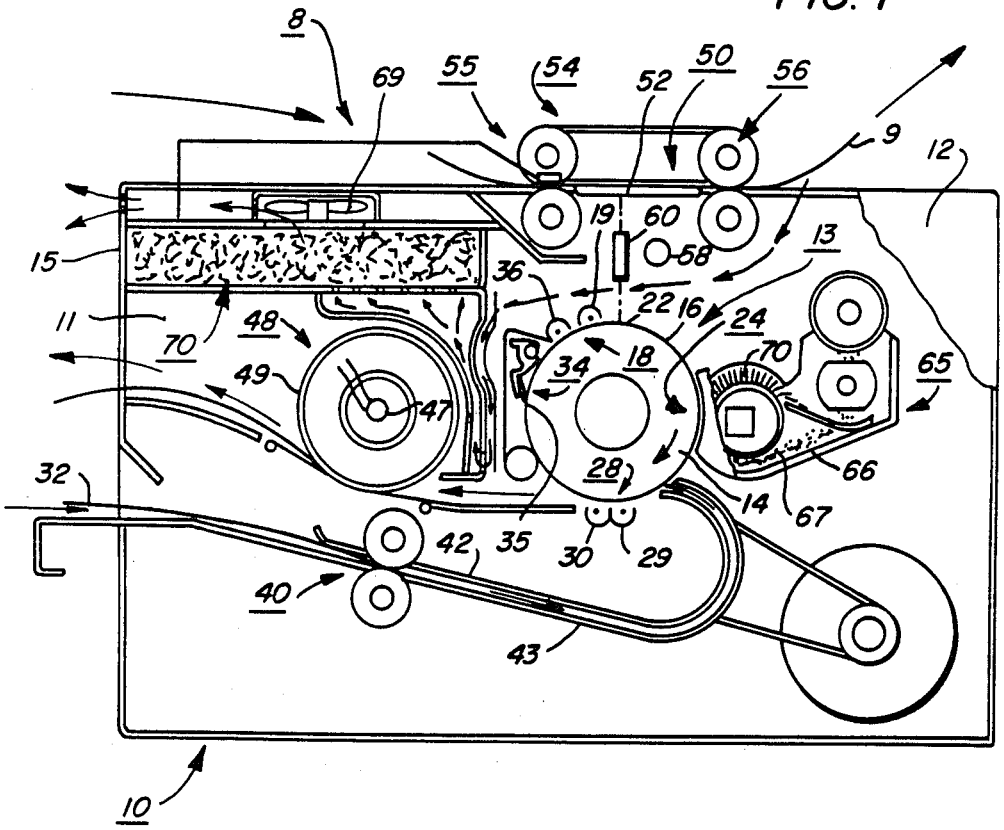
FIG. 1 is a side view in section of a copying/printing machine having the thermal barrier air curtain of the present invention.

Referring to FIG. 1 of the drawings, there is shown a xerographic type reproduction machine 8 incorporating the present invention. Machine 8 has a suitable frame or housing 10 with sides 11, 12 within which the machine xerographic section 13 is operatively supported. Briefly, and as will be familiar to those skilled in the art, the machine xerographic section 13 includes a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document 9 being copied or reproduced, development station 24 where the latent electrostatic image created on photoconductive surface 16 is developed by toner, transfer station 28 with transfer corotrons 29, 30 for transferring the developed image to a suitable copy substrate material such as a copy sheet 32 brought forward in timed relation with the developed image on photoconductive surface 16, and cleaning station 34 with cleaning blade 35 and discharge corotron 36 for removing leftover developer from photoconductive surface 16 and neutralizing residual charges thereon.

Copy sheets 32 are brought forware to transfer station 28 by feed roll pair 40, sheet guides 42, 43 serving to guide the sheet through an approximately 180° turn prior to transfer station 28. Following transfer, the sheet 28 is carried forward to a fusing section 48 where the toner image is fixed by fusing roll 49. Fusing roll 49 is heated by a suitable heater such as lamp 47 disposed within the interior of roll 49. After fixing, the copy sheet 28 is discharged.

A transparent platen 50 supports the document 9 as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56 respectively on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving receptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 68 is disposed in predetermined operative relation to the photoconductive surface 16 in developer housing 65, roll 68 serving to bring developer from sump 66 into developing relation with photoreceptor 14 to develop the latent electrostatic images formed on the photoconductive surface 16.

In the aforedescribed machine, and as particularly seen in FIG. 1, the xerographic section 13 and fusing section 48 are disposed in close proximity to one another, thereby permitting a substantial reduction in the width of machine 8 and enhancing machine compactness. However, reducing the space between the xerographic and the fusing sections tends to increase the transfer of objectionable heat from fusing section 48 into the xerograhic section and the areas adjacent the xerographic section. This can result in overheating of photoreceptor 14 leading to a loss of image contrast due to heat induced increase in dark decay current. Further, exposure of photoreceptor 14 to excess heat may result in crystallization of the photoreceptor alloy. Additional problems raised by exposure of the xerographic section to excessive heat from the fusing section are congealing of scavanged toner laying in the sump 66 of developer housing 65 and unwanted open wire corona discharges by corotron 19 resulting in reduced corotron efficiency.

Figure 2:
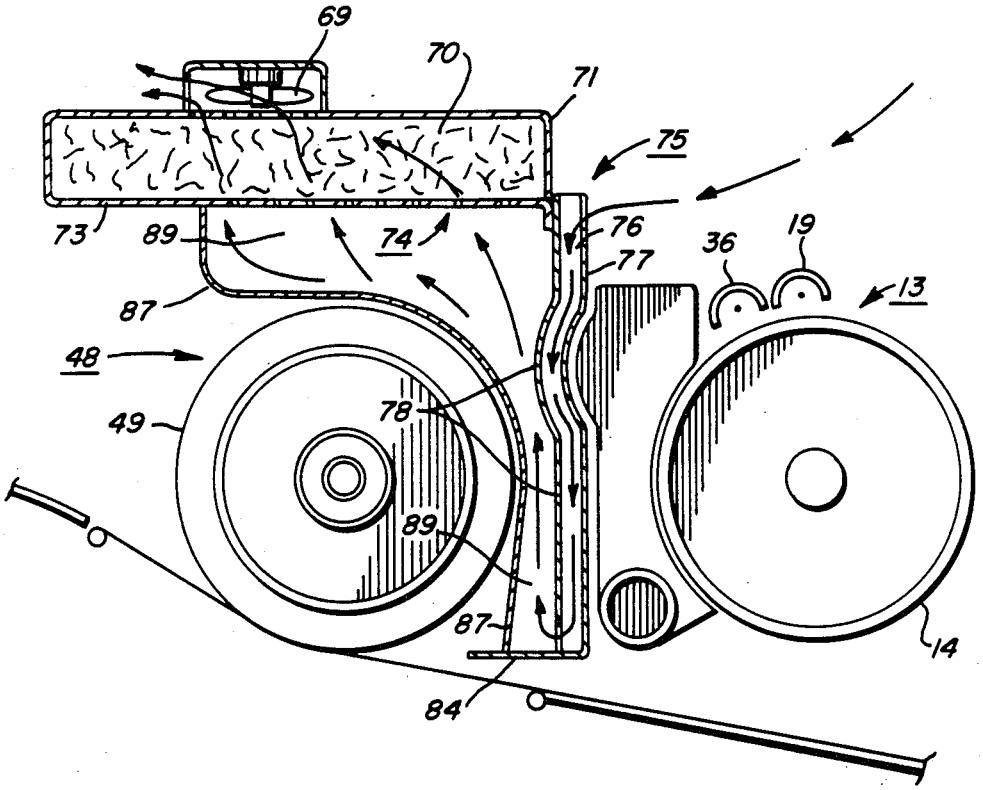
FIG. 2 is an enlarged view in section showing details of the air manifold and baffle plate between the xerographic and fuser sections of the machine shown in FIG. 1.
Figure 3:
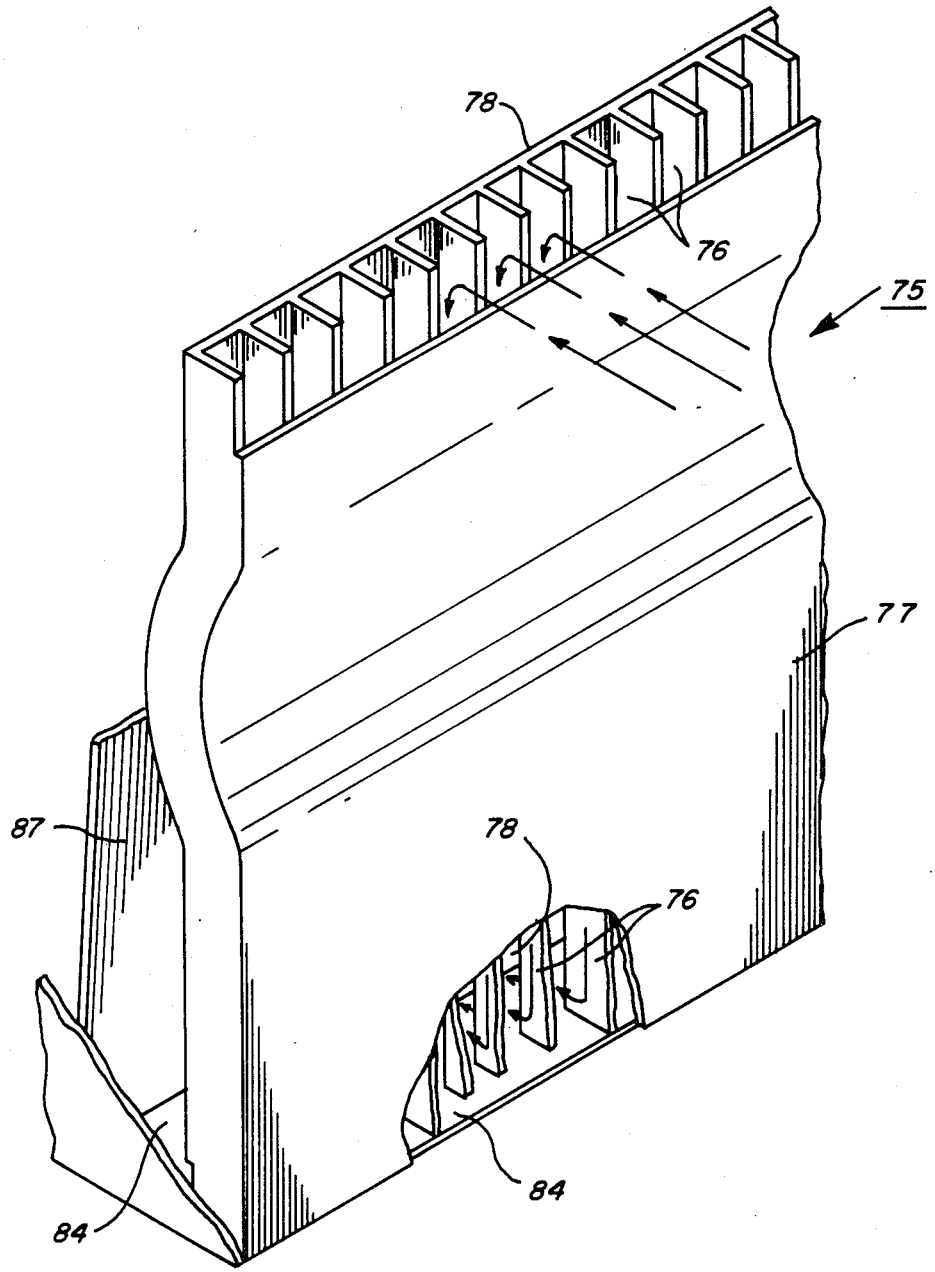
FIG. 3 is a top view of the air manifold shown in FIG. 2 illustrating the air passages therewithin.

Referring to FIGS. 1–3, and particularly FIGS. 2 and 3, to control temperature conditions within housing 10 of machine 8 and reduce and control ozone, air is exhausted from the interior of machine housing 10 by means of one or more fans 69, fan 69 discharging through wall 15 of housing 10 into the area surrounding machine 8. To prevent discharging of dirt, dust, and other particulate material into the surrounding area, a suitable filter 70 is provided adjacent the fan inlet, filter 70 being supported within a generally rectangular housing 71 that extends between sides 11, 12 of housing 10. Filter housing 71 has an inlet 74 in the lower wall or side thereof.

To inhibit transfer of heat from fusing section 48 to xerographic section 13, an air manifold 75 is provided between the sections 13, 48. Manifold 75 comprises an elongated sheet-like part formed for example from a clear plastic, having a sucession of air passages 76 formed therein and extending across the width of the machine housing 10 between xerographic and fusing section 13, 48 respectively. Passages 76 lead from a point adjacent the top of mainfold 75 to a point adjacent to the bottom of manifold 75.

To assure that substantially all air flowing through xerographic section 13 flows through passages 76 of manifold 75, the length of manifold 75 is such that manifold 75 extends from side 11 of machine 8 to side 12. Inner wall 78 of manifold 75 is joined with filter housing 71 along one side of the air inlet 74 to filter 70. The lower end of base 84 of manifold 75 is extended toward fusing section 48. Base 84 of manifold 75 is spaced above the path followed by the copy sheets 32.

A curved air guide or baffle 87 is connected between base 84 of manifold 75 and the lower side 73 of filter housing 71 adjacent the inside edge of filter air inlet 74. Baffle 87 has a radius of curvature substantially the same as that of fusing roll 49 to allow baffle 87 to be placed in close but spaced relation with the surface of fusing roll 49. Accordingly, the inner wall 78 of manifold 75 together with baffle 87 cooperate to form a controlled passage 89 for air leading to filter air inlet 74, the opposing sides 11, 12 of the machine housing functioning to provide the sides of passage 89.

During operation of machine 8, fan 69 is energized together with the various operating components of xerographic section 13 and fuser section 48. Fan 69 draws air through the interior of housing 10 to filter 70 and through filter 70 to the outside, the air being drawn principally form xerographic section 13 including the area around corotrons 19, 36 and lens array 60, and from the interior of developer housing 65. The air flowing over and around corotron 19, 36 reduces the build up of ozone that normally attends corotron operation.

The air from xerographic section 13 is drawn into the passages 76 of air manifold 75 adjacent the top, the air flowing downwardly within the confines of passages 76 and exiting adjacent base 84 into the space between the out wall 78 of manifold 75 and baffle 87. The stream of air leaving passages 76 of air manifold 75 then flows upwardly within the confines of the passage 89 formed by the inner wall 78 and base 84 of manifold 75 and air baffle 87 to air inlet 75 of filter 70. The air entering filter 70 is filtered to remove particulate materials such as dirt, dust, etc. before discharge of the air by fan 69.

The spaced apart counter flowing streams of air flowing in passages 76 of manifold 75 and in passage 89 each form a curtain or thermal buffer between xerographic section 13 and fuser section 48. Heat emanating from fuser section 48 that would ordinarily be transmitted across the space between xerographic and fuser sections 13, 48 is instead drawn by the air steam in passage 89 through filter 70 and exhausted, cooling the area between xerographic and fuser sections 13, 48 respectively. Manifold 75, which has a stream of cooling air passing therewithin, forms a heat stop or block between xerographic and fuser sections 13, 48, and heat absorbed by manifold 75 is transmitted to the stream of air flowing through passages 76 to further inhibit and prevent transfer of heat from fuser section 48 to xerographic section 13.

While the invention has been described with reference to the structure disclosed, it is not confined to the details set forth, but is intended to cover such modifications or changes as may come within the scope of the following claims.

We claim:

1. In a copying/printing machine having a xerographic section including a photoreceptor on which latent electrostatic images are formed and developed, and thereafter transferred to a copy substrate material, and a fusing section where the developed image transferred to the copy substrate material is fixed by heat, the xerographic section and the fusing section being disposed in close adjoining relation to one another to provide maximum machine compactness, the combination of:

(a) an exhaust fan for generating a flow of air internally of said machine, said fan discharging air outside said fusing section;

(b) a filter upstream of said fan for filtering said air prior to discharge by said fan;

(c) means forming an elongated chamber in the space between said xerographic section and said fusing section extending across the width of the space between said xerographic section and said fusing section;

(d) a substantially vertical wall in said chamber separating said chamber into first and second back to back air passages;

said first passage bordering said xerographic section and having air inlet means adjacent the upper end thereof opening into said xerographic section through which air is drawn from said xerographic section;

said second passage bordering said fusing section and being closed to said fusing section, said second passage having air outlet means adjacent the upper end thereof communicating with said filter through which air is discharged to said filter for discharge by said fan;

said wall having aperture means adjacent the bottom thereof connecting said first passage with said second passage, so that air drawn from said xerographic section is forced to follow a generally U-shaped path from said air inlet means downwardly through said first passage, through said aperture means to said second passage, and upwardly through said second passage to said outlet means whereby there is provided a pair of back to back curtains of moving air flowing in opposite directions to one another between said xerographic and fuser section, said pair of air curtains cooperating to inhibit transfer of heat from said fusing section to said xerographic section.

2. The machine according to claim 1 in which said wall separates said first passage into a plurality of discrete parallel air passages.

* * * * *